US008373639B2

(12) United States Patent
Ohlson

(10) Patent No.: US 8,373,639 B2
(45) Date of Patent: Feb. 12, 2013

(54) DEVICE AND METHOD FOR ADJUSTMENT OF A WORK PLACE ILLUMINATION

(75) Inventor: Carl-Eric Ohlson, Stockholm (SE)

(73) Assignee: AO Medical Products Sweden Aktibolag, Kista (SE)

( * ) Notice: Subject to any disclaimer, the term of this patent is extended or adjusted under 35 U.S.C. 154(b) by 1640 days.

(21) Appl. No.: 10/542,741

(22) PCT Filed: Jan. 20, 2004

(86) PCT No.: PCT/SE2004/000064

§ 371 (c)(1),
(2), (4) Date: Jan. 30, 2006

(87) PCT Pub. No.: WO2004/066134

PCT Pub. Date: Aug. 5, 2004

(65) Prior Publication Data

US 2006/0244717 A1 Nov. 2, 2006

(30) Foreign Application Priority Data

Jan. 20, 2003 (SE) ..... 0300114

(51) Int. Cl.
*G09G 3/36* (2006.01)

(52) U.S. Cl. ..... 345/102; 348/602

(58) Field of Classification Search ..... 345/615, 345/690, 204, 87–104, 207; 348/602
See application file for complete search history.

(56) References Cited

U.S. PATENT DOCUMENTS

| | | | | |
|---|---|---|---|---|
| 5,044,284 A | | 9/1991 | Gross | |
| 5,057,744 A | * | 10/1991 | Barbier et al. | 315/10 |
| 5,083,195 A | | 1/1992 | Evelin | |
| 5,086,385 A | * | 2/1992 | Launey et al. | 700/83 |
| 5,339,750 A | | 8/1994 | Smies | |
| 5,398,622 A | | 3/1995 | Lubinskas et al. | |
| 5,786,801 A | * | 7/1998 | Ichise | 345/102 |
| 5,850,205 A | * | 12/1998 | Blouin | 345/102 |
| 5,857,415 A | | 1/1999 | Richard | |
| 6,795,053 B1 | * | 9/2004 | Funamoto et al. | 345/102 |
| 2001/0056314 A1 | | 12/2001 | Lomonaco et al. | |

FOREIGN PATENT DOCUMENTS

| | | | |
|---|---|---|---|
| DE | 42 07 417 A1 | | 9/1993 |
| DE | 10037556 | * | 2/2002 |
| DE | 101 26 684 A1 | | 7/2002 |
| GB | 2187902 A | * | 9/1987 |
| JP | 2027412 A | | 1/1990 |
| JP | 2002352966 A | | 4/1990 |
| WO | WO 94/16374 | | 7/1994 |
| WO | WO 9416374 A1 | * | 7/1994 |
| WO | WO 0068926 A1 | * | 11/2000 |

OTHER PUBLICATIONS

Human translation of DE 10037556.*

* cited by examiner

*Primary Examiner* — Michael Pervan

(74) *Attorney, Agent, or Firm* — The Maxham Firm

(57) ABSTRACT

A device and method for adjustment of a work place illumination in computerized image presentation, a detection device being arranged to detect the current light and/or contrast values of at least one active presentation surface, that the detection device is connected to a control and adjustment device arranged to automatically adjust the work place illumination of the presentation surface depending on reference values determined in the control and adjustment device in relation to the current light and/or contrast value of the presentation surface.

35 Claims, 1 Drawing Sheet

DEVICE AND METHOD FOR ADJUSTMENT OF A WORK PLACE ILLUMINATION

TECHNICAL FIELD OF THE INVENTION

The present invention relates to the field of image ergonomics in computerized work for display of images on a presentation surface, in particular in computer terminal work.

BACKGROUND OF THE INVENTION

So-called workstations for computer terminal work are in general embraced by the description below but in particular medical applications with the purpose of making diagnoses based on anatomical images of focused objects.

The diagnostic examination work of patient images from X-ray, MR (magnetic resonance imaging scanner) and ultrasound examinations requires great concentration and is more or less trying depending on prevailing circumstances regarding illumination and ergonomic functions with regard to strain and load.

A large disadvantage upon analogous examination of X-ray film, which is transilluminated by a light field lying behind, has always been disturbing stray light outside the limits of the film, which is both tiring and makes the diagnosis of examined objects more difficult. It is true that this can be remedied by delimiting dimming curtains, which however require both concentration and time to manoeuvre and not the least depending on the occurring different film sizes.

Another disadvantage of the analogous technique is the risk of underexposed and overexposed images, i.e., light and dark films, respectively.

Upon change to digital examination by computerized display devices, the disturbing-light problem becomes negligible and too light or dark images are fixed by so-called image manipulation.

The difference in light intensity between analogous negatoscopes and display devices is about factor 10, but counted in light transmission, the difference is negligible and occasionally the opposite.

Therefore, it is not unusual that the user erroneously thinks that the sharpness and contrast of the details on the display device are improved by a weak surrounding illumination.

Too low a light intensity of the surrounding illumination in relation to the display device may have the opposite effect and become tiring by generating so-called melatomia, i.e., sleep requirement. Upon trying to focus on adjacent papers having text, also the reading is made more difficult due to erroneous luminance ratio.

The National Swedish Board of Health and Welfare is, for instance, of the opinion that good contrast for doing computer terminal work is at hand if the luminance ratios between adjacent surfaces in the working area, i.e., so-called infield, surround field and outer field of vision, should be of 5:3:1. The infield is within a radius of about 20 cm from the focus of the examiner, surround field within a radius of about 40-50 cm and outer field of vision beyond that.

In conclusion, the following primary physiological factors are valid for the function of the eye and working capacity-decreasing results: At a large pupil, the depth of field of the eye decreases, thereby increasing requirements on correct viewing distance.

Too weak light deteriorates the detail viewing in varying degree.

From this, anybody realizes that the combination mentioned above considerably increases the risk of imperfectly made diagnoses, such as, e.g., undiscovered tumours or other symptoms being life-threatening or serious to the patient.

The number of digital workstations varies with the size and extent of the examination unit. A smaller department comprises as a rule 4-8 workstations and a larger 20-30 workstations. Even if the workstations are distributed between various numbers of rooms, it is inevitable that a smaller or greater number of workstations are placed neighbouring each other for reasons of space or organisation. Thereby, upon image analysis and diagnostics, varying disturbances arise in concentration depending on the activity of the department and the amount of movable personnel and not the least incident light from windows, inappropriately placed general lighting, etc.

It is true that the imaging technique of the computerized digital workstations offers many technical and ergonomic advantages in order to facilitate image processing, analysis and diagnosis in comparison with analogous technique. Unfortunately, in other respects the equipment is not adapted to existing wishes and ergonomic requirements with regard to vision, strain and workload.

The shortcomings of the digital workstations in vision ergonomics are summarized according to the following:

Measures are lacking for facilitating the light adaptation and contrast viewing of the eye at different viewing conditions.

Screening off of the workstations from disturbing factors such as external illumination, incident glaring daylight via windows as well as activities from other personnel and equipment such as, e.g., other workstations, so-called large screen projectors, copying machines, automatic drink dispensers, etc., is inferior.

Object Of The Invention

By the invention, the drawbacks mentioned above are solved by the fact that the device and the method ensures that surrounding light source(s) is(are) automatically adapted to requirements on luminance ratio in order to thereby optimise the depth of field and detail viewing of the eye.

SUMMARY OF THE INVENTION

By the present invention such as the same is defined in the independent claims, the above-mentioned object is met. Suitable embodiments of the invention are defined in the dependent claims.

As one embodiment, the invention comprises a workstation for computer terminal work provided with at least one sensor for measuring the light intensity of one or more display devices. In this connection, each display device may be connected to a sensor.

Additional embodiments within the scope of the present invention are shown below.

A device for automatically, linearly or progressively, stepwise or variably adapting the surrounding light sources of the workstation in relation to the light intensity of any display device within preset values for optimal or optional ranges in terms of luminance ratios.

Upper, rear or several light sources ajapted for automatic light intensity.

A device for measuring at least one light intensity of display devices in computerized workstations either externally by separate sensor or internally in the display device during scanning of the display image in CRT screens or during de-coding of a matrix of LCD (flat) screens for automatic adaptation of the light intensity of surrounding light sources to the light intensity of the display device within preset values for optimal or optional luminance ratio with a settable adjustment of limit values of the light source.

Distance-adapted automatic adjustment of the light intensity in relation to alteration of the distance between the user and the light source.

At least two integrated light sources for automatic or optional luminance ratio.

That the device for adjustment of surrounding illumination is controlled by the display device used for the moment.

That the display device used for the moment is recorded by means of the device that the user uses for the moments, e.g. the cursor's positioning by computer mouse.

That a plurality of display devices may be connected to "one" common cursor.

That above-mentioned light source is delimited to illuminate surfaces of surround and outer field of vision. That above-mentioned light source is delimited in the direct and indirect viewing direction of the user.

That the user uses pre-programmed personal settings of light sources and the adjustment thereof.

Fixed or movable screening off devices in order to delimit, e.g., external light sources and activities in progress by other personnel or equipment, which may affect intended conditions for the work result. That such a screening off device is movable in the horizontal plane.

To subordinate a light source in the room, being external to the workstation, to the illumination function of the workstation.

A so-called movement detector in order to detect if a user is within the working space of the invention in order to control internal and external functions having connection to the object of the invention.

A device for temporary or permanent integration of external light sources for control and adjustment of light intensity as well as connection and disconnection.

By the invention, the traditional terminal work may be substantially facilitated by supplementing functions that are important for ergonomic vision such as adapted illumination technique and delimitation of disturbing surrounding factors.

By letting the light intensity of the focused viewing field of the eye controlling surrounding light intensities, a pleasant adaptation of secondary lighting conditions for the surround field and the outer field of vision to the primary infield of the user is attained. By means of this, dissimilarities between the current light intensity of the display device and the surrounding illumination are levelled out.

The light intensity for the control by the display device of secondary lighting conditions of surrounding light sources may be read in various ways. In a device stand separate from the computer system, a light-sensitive sensor may, e.g., be placed adjacent to the concerned display device or at an arbitrarily distance but preferably focused to the display image.

For workstations containing more than one display device, it is suitable to provide each display device with an individual light-reading. In order to, in that connection, facilitate the connection of the display device intended for the moment for light control, for instance the pointer (cursor) of the display device being used may activate the local reading.

In order to adapt said mutual lighting conditions to occurring deviations between different users, the light intensities may be adjusted according to personal wishes either manually or automatically. Thereby, the difference between the light of the display device and that of the illumination may optionally be decreased or increased.

The light intensity of the controlled surrounding illumination may be adjusted in respect of the absolute lowest and highest level of the light source, as well as in respect of the relative light intensity of the light source. This means that the limit values for occurring light source may optionally vary more or less within a low or within a high light intensity.

In order not to limit the degrees of freedom of the work place illumination, the user may, as a nomial activity, connect the light intensity controlled by the display device and in disconnected position turn on, switch off or set the light intensity separately for the respective light source.

In order to additionally facilitate the operation of the invention by the user, the above-mentioned options for individual setting of the controlled light intensities of the surrounding illuminations may be preset according to personal wishes. Said preset values may then be activated, e.g., via a control means intended for the purpose or upon so-called login into the workstation, i.e., when the user enters a code in order to use the current computer system.

The light sources of the invention are dimmed both directly and indirectly in order to eliminate disturbing light surfaces in the surround field and outer field of vision of the user. Only necessary light surfaces will be illuminated, such as, e.g., the tabletop and delimited surfaces, by automatically or manually set light intensities.

By using a remote movement detector already known in the art in order to turn on and switch off light sources, the light sources of the invention may be adjusted as well as also concerned external light sources.

External light sources, which may be both directly and indirectly disturbing, may be delimited or screened off by fixed and/or movable screens. A direct disturbance may, e.g., consist of incident daylight in the eyes of the user through windows and indirect via reflections in the display device.

Other disturbances, which may be screened off, are intermittent or permanent moving activities in the field of vision of the user.

External light sources may then be controlled and adjusted by the control means of the invention by direct connection to existing permanent electric installation or via known wireless devices for, e.g., IR communication.

BRIEF DESCRIPTION OF THE DRAWINGS

The invention will now be described in more detail by means of embodiment examples, reference being made to the accompanying drawings where.

DESCRIPTION OF THE INVENTION

Figure 1:
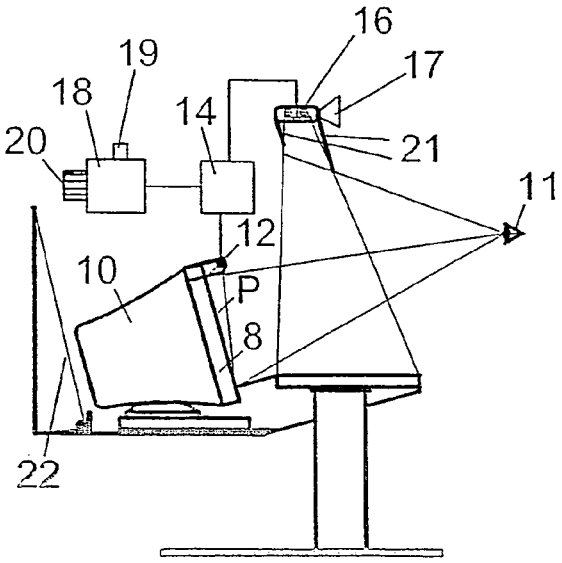
FIG. 1 shows a side view of a work place having a display device equipped with an external device according to the invention.

A presentation surface P, in FIG. 1 shown as a display device 8 on a monitor 10, is active when the surface, seen by an observer 11, shows an display image having determined values of the light properties of light intensity and luminance between different segments in the image. The light properties of the presentation surface are detected by an external detection device 12, which either scans the display image in order to record maximum and minimum of said values or only detects a mean value of the detected surface. The detection device 12 is mounted at the upper edge of the front rim of the monitor and directed towards the display device 8 thereof. To the detection device 12, a control and adjustment device 14 is connected, which in turn is connected to a work place illumination 16. As is also seen in the figure, a movement detector 17 is connected to the work place illumination 16, the detector being arranged to remotely detect a user's presence within the area of the work place and being arranged to control internal and external functions. To the control and adjustment device 14, a redirection means 18 is connected, which upon manoeuvre via a hand wheel 20 provides a disconnection of the control and adjustment device 14 so that a direct manual control of the work place illumination 16 can be effected. The redirection means is provided with a resetting button 19, which upon activation resets the system in automatic mode. The control and adjustment device 14 is programmable, the levels of the light intensity of the work place illumination in relation to the light properties of the display device being entered. The work place illumination 16 is furthermore provided with screening off devices 21 for direct light flux, on one hand towards the display device 8 and on the other hand towards the observer 11. Furthermore, an angularly movable light reflector 22 is placed behind the monitor 10 in order to reflect place light in a non-disturbing way.

Figure 2:
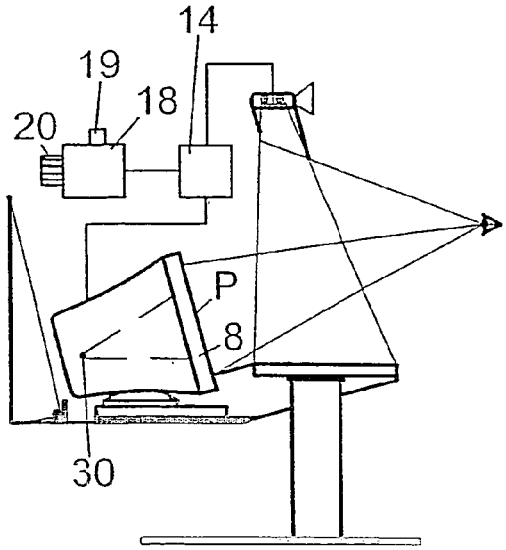
FIG. 2 shows a side view of a work place having a display device equipped with an internal device according to the invention.

According to a second embodiment, shown in FIG. 2, of the invention, for instance the centred light value of the display device 8 or the total mean value may be decoded by a device in the form of an internal detection device 30 integrated with the computer system. For so-called CRT screens having picture tubes of the cathode ray type, the scanning of the display image by the ray may be read and for so-called flat screens of LCD type having liquid crystals, the dot matrix may be decoded in the X and Y directions.

A detailed description of the technique for the internal decoding of the display device becomes too extensive and is therefore limited to a simple principle. The decoding method assumes that the detection device 30 is integrated with the internal image control of the monitor and the external equipment in the form of the control and adjustment device 14 and the work place illumination 16. In correspondence to what has been shown with regard to the embodiment according to FIG. 1, a redirection means 18 is connected, which upon manoeuvre via a hand wheel 20 provides a disconnection of the control and adjustment device 14. The redirection means is provided with a resetting button 19, which upon activation resets the system in automatic mode.

The structure of the display is based on display elements, so-called pixels, oriented as co-ordinates in the X and Y directions. The position and light intensity of the display elements are voltage dependent and are essentially generated by the computer's so-called graphics card, which in turn is controlled by the computer's drivers via the CPU unit (Central Processing Unit), which contains the computer's primary software. By means of the above-described functions and conditions, the exact position and light intensity of the display elements, either in grey-scale or colour scale, may be controlled by the program and the requisite electronics. The invention according to this embodiment is arranged to conversely and simultaneously externally forward this display image information related to an arbitrary part of the image area, in order to be processed in a way corresponding to the case of effecting the detection of the lighting conditions of the display device from outside.

Figure 3:
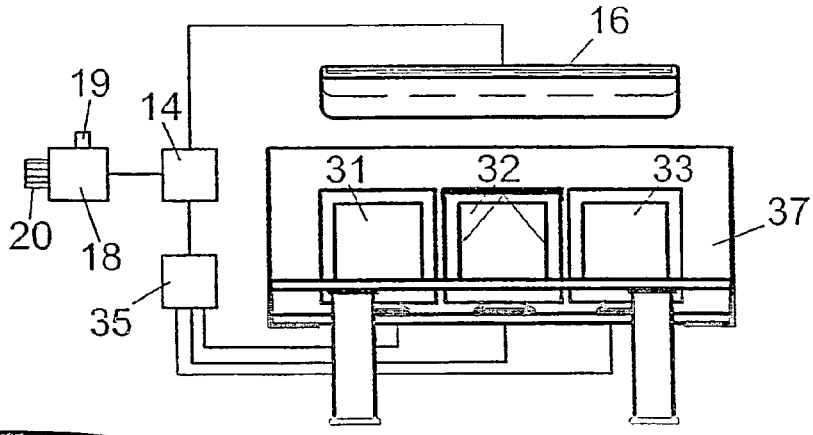
FIG. 3 shows a work place comprising three display devices, one of which is equipped with an external device and two are equipped with an internal device according to the present invention.

FIG. 3 shows a work place having three monitors and thus three display devices, 31, 32, 33, each one of which is connected to a detection device each, the middle display device of which is provided with an external device while the other two are provided with internal devices. The signals from respective detection device are collected in a master-slave unit 35, to which also the cursor signal of each monitor is connected, while that one of the screens' cursor controls which is being active for the moment defines master for the adjustment of the work place illumination. Should a plurality of cursor controls be active simultaneously, master is defined by a mutual hierarchy between the screens. Other screens will constitute slaves. The master-slave unit is connected to a control and adjustment device 14, which in turn is connected to a work place illumination 16. To the control and adjustment device 14, a redirection means 18 is correspondingly connected, which upon manoeuvre via a hand wheel 20 provides a disconnection of the control and adjustment device 14 so that a direct manual control of the work place illumination 16 may be effected. The redirection means 18 is provided with a resetting button 19, which upon activation resets the system in automatic mode. Behind the monitors, a screen wall 37 is located in order to, on one hand, screen off the work place, and on the other hand reflect light in a suitable way.

Figure 4:
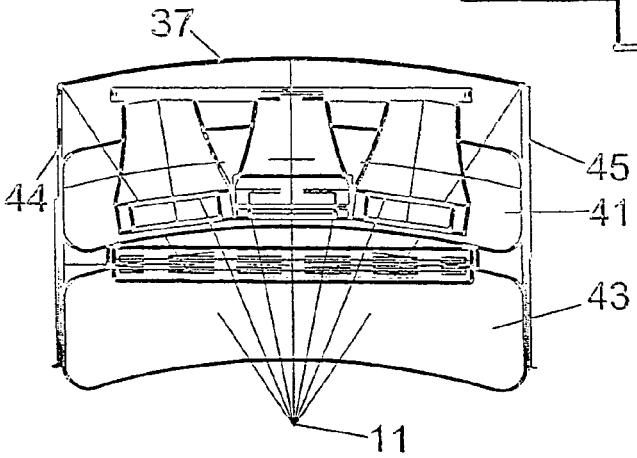
FIG. 4 shows a top view of the work place according to FIG. 3.

FIG. 4 shows a top view of the work place according to FIG. 3, the location of the monitors having been made angled so that the observer 11 should be able to study a plurality of images simultaneously and as ergonomically advantageously as possible. Also monitor table 41 and worktable 43 are formed bent for the best ergonomics. In order to additionally screen off the work place from disturbance sources, the table 43 is provided with a left and a right screen wall 44, 45 as complement to the screen wall 37.

The work places shown in the figures are furthermore associated with a login operation, which identifies the current user. In this connection, the login results in that user data is retrieved from a database so that the user in question always begins to work having his/her own settings. Of course, new settings after the end of the working period may be stored for coming working sessions. Also the choice of a plurality of individual settings may be made.

The invention claimed is:

1. A device for adjustment of a work place illumination in connection with computerized image presentation, the device comprising:

at least one active display device;

a detection device configured to detect the current light or contrast values, or both, of light coming directly from said at least one active display device and to thereby provide an objective measure of the light intensity of images displayed on said display device, said detection device having a field of view limited to the viewing surface of said active display device;

a control and adjustment device connected to said detection device, said control and adjustment device being configured to automatically adjust the work place illumination of said at least one active display device depending on reference values determined in said control and adjustment device in relation to the current light or contrast values, or both, of said at least one active display device, thereby enhancing ergonomic visibility of said image.

2. The device according to claim 1, wherein said detection device is configured for a continuous detection.

3. The device according to claim 2, wherein said control and adjustment device is configured to provide a variable adjustment.

4. The device according to claim 1, wherein said control and adjustment device is configured to provide a variable adjustment.

5. The device according to claim 4, and further comprising a redirection means, wherein said work place illumination is connected to said redirection means configured to eliminate the automatic adjustment in favour of a manual adjustment.

6. The device according to claim 4, wherein the reference values of said control and adjustment device are individually determined and are set dependent on login on a coupled workstation.

7. The device according to claim 4, wherein said detection device is formed as an internal sensor device in said at least one active display device, said sensor device being configured to detect the pixel structure of said at least one active display device in respect of the light or contrast values, or both, of the pixels.

8. The device according to claim 4, wherein said detection device is formed as an external sensor directed toward a presentation surface of said at least one active display device in order to detect current light or contrast values, or both, of light coming directly from said at least one active display device.

9. The device according to claim 4, wherein each said at least one active display device is arranged to be detected by a said detection device, each said detection device being connected to a cursor control of said at least one active display device and said cursor control of each said at least one active display device is connected in a master-slave unit so that said cursor control is active for the moment and is configured to act as master while the other controls are arranged to constitute slaves, said master control being configured to adjust the work place illumination.

10. The device according to claim 4, and further comprising a movement detector configured to remotely detect the presence of a user within the area of the work place as well as being configured to control internal and external function.

11. The device according to claim 1, and further comprising a redirection means, wherein said work place illumination is connected to said redirection means configured to eliminate the automatic adjustment in favour of a manual adjustment.

12. The device according to claim 11, wherein the reference values of said control and adjustment device are individually determined and are set dependent on login on a coupled workstation.

13. The device according to claim 11, wherein said detection device is formed as an internal sensor device in said at least one active display device, said sensor device being configured to detect the pixel structure of said at least one active display device in respect of the light or contrast values, or both, of the pixels.

14. The device according to claim 11, wherein said detection device is formed as an external sensor directed toward a presentation surface of said at least one active display device in order to detect current light or contrast values, or both, of light coming directly from said at least one active display device.

15. The device according to claim 1, wherein the reference values of said control and adjustment device are individually determined and are set dependent on login on a coupled workstation.

16. The device according to claim 15, wherein said detection device is formed as an external sensor directed toward a presentation surface of said at least one active display device in order to detect current light or contrast values, or both, of light coming directly from said at least one active display device.

17. The device according to claim 15, wherein each said at least one active display device is arranged to be detected by a said detection device, each said detection device being connected to a cursor control of said at least one active display device and said cursor control of each said at least one active display device is connected in a master-slave unit so that said cursor control is active for the moment and is configured to act as master while the other controls are arranged to constitute slaves, said master control being configured to adjust the work place illumination.

18. The device according to claim 15, and further comprising a movement detector configured to remotely detect the presence of a user within the area of the work place as well as being configured to control internal and external function.

19. The device according to claim 1, wherein said detection device is formed as an internal sensor device in said at least one active display device, said sensor device being configured to detect the pixel structure of said at least one active display device in respect of the light or contrast values, or both, of the pixels.

20. The device according to claim 19, wherein each said at least one active display device is arranged to be detected by a said detection device, each said detection device being connected to a cursor control of said at least one active display device and said cursor control of each said at least one active display device is connected in a master-slave unit so that said cursor control is active for the moment and is configured to act as master while the other controls are arranged to constitute slaves, said master control being configured to adjust the work place illumination.

21. The device according to claim 19, and further comprising a movement detector configured to remotely detect the presence of a user within the area of the work place as well as being configured to control internal and external function.

22. The device according to claim 1, wherein said detection device is formed as an internal sensor device in said at least one active display device, said sensor device being configured to detect the pixel structure of said at least one active display device in respect of the light or contrast values, or both, of the pixels.

23. The device according to claim 1, wherein said detection device is formed as an external sensor directed toward a presentation surface of said at least one active display device in order to detect current light or contrast values, or both, of light coming directly from said at least one active display device.

24. The device according to claim 23, wherein each said at least one active display device is arranged to be detected by a said detection device, each said detection device being connected to a cursor control of said at least one active display device and said cursor control of each said at least one active display device is connected in a master-slave unit so that said cursor control is active for the moment and is configured to act as master while the other controls are arranged to constitute slaves, said master control being configured to adjust the work place illumination.

25. The device according to claim 23, and further comprising a movement detector configured to remotely detect the presence of a user within the area of the work place as well as being configured to control internal and external function.

26. The device according to claim 1, wherein each said at least one active display device is arranged to be detected by a said detection device, each said detection device being connected to a cursor control of said at least one active display device and said cursor control of each said at least one active display device is connected in a master-slave unit so that said cursor control is active for the moment and is configured to act as master while the other controls are arranged to constitute slaves, said master control being configured to adjust the work place illumination.

27. The device according to claim 26, and further comprising a movement detector configured to remotely detect the presence of a user within the area of the work place as well as being configured to control internal and external function.

28. The device according to claim 1, and further comprising a movement detector configured to remotely detect the presence of a user within the area of the work place as well as being configured to control internal and external function.

29. A method for adjustment of a work place illumination in computerised image presentation, the method comprising:

directly detecting the current light or contrast values, or both, of light coming directly and substantially only from at least one active display device using a detecting means having a field of view limited to the viewing surface of the active display device and configured to provide an objective measure of light intensity of images displayed on said active display device; and automatically adjusting by means of a control and adjustment device the surrounding work place illumination of the at least one active display device depending on reference values determined in the control and adjustment device in relation to the current light or contrast values, or both, of the at least one active display device, thereby enhancing ergonomic visibility of said images.

30. The method according to claim 29, wherein the detection takes place continuously.

31. The method according to claim 30, wherein the adjustment takes place variably.

32. The method according to claim 30, and further comprising scanning the at least one active display device to provide the detecting.

33. The method according to claim 29, wherein the adjustment takes place variably.

34. The method according to claim 33, and further comprising scanning the at least one active display device to provide the detecting.

35. The method according to claim 29, and further comprising scanning the at least one active display device to provide the detecting.

* * * * *